US007121852B2

(12) United States Patent
Ng et al.

(10) Patent No.: US 7,121,852 B2
(45) Date of Patent: Oct. 17, 2006

(54) USB CONNECTOR STRUCTURE

(75) Inventors: Chong-Khai Ng, Taipei (TW); Shih-Hsiung Weng, Taipei (TW)

(73) Assignee: Inventec Multimedia & Telecom Corporation, (TW)

( * ) Notice: Subject to any disclaimer, the term of this patent is extended or adjusted under 35 U.S.C. 154(b) by 0 days.

(21) Appl. No.: 11/171,971

(22) Filed: Jun. 29, 2005

(65) Prior Publication Data

US 2006/0073717 A1 Apr. 6, 2006

(30) Foreign Application Priority Data

Oct. 4, 2004 (TW) ..... 93215677 U

(51) Int. Cl.
*H01R 13/44* (2006.01)

(52) U.S. Cl. ..... 439/131; 439/165; 439/8; 439/31

(58) Field of Classification Search ..... 439/8, 439/131, 31, 165
See application file for complete search history.

(56) References Cited

U.S. PATENT DOCUMENTS 6,193,522 B1 * 2/2001 Liao ..... 439/31
6,213,782 B1 * 4/2001 Derstine ..... 439/31
6,659,782 B1 * 12/2003 Wu ..... 439/131
6,786,743 B1 * 9/2004 Huang ..... 439/131
6,939,150 B1 * 9/2005 Lanni ..... 439/131

OTHER PUBLICATIONS

Taiwan Publication No. 572263 entitled "Portable Wireless Receiving Device with Functions of Storage and Interfacing".

* cited by examiner

*Primary Examiner*—Truc Nguyen
(74) *Attorney, Agent, or Firm*—Peter F. Corless; Steven M. Jensen; Edwards Angell Palmer & Dodge LLP

(57) ABSTRACT

A connector structure is proposed, which includes a body having at least one containing space; at least one first connector being inwardly disposed at one end of the body; at least one second connector being pivotally disposed on the other end of the body, which can be accommodated in the containing space of the body; and at least one rotating element being pivotally connected onto one end of the body, the second connector being fastened onto the rotating element, wherein the rotating element at least has one arm portion, one end of the arm portion being disposed with a pivotal connecting portion which connects to one end of the body. The connector structure further has a switch actuated by the rotation of the pivotal connecting portion of the rotating element thereof, wherein the rotation angle of the switch can control electric conduction of the first connector and the second connector.

10 Claims, 12 Drawing Sheets

USB CONNECTOR STRUCTURE

BACKGROUND OF THE INVENTION

1. Field of the Invention

This invention relates to a connector structure, and more particularly, to an improved connector structure having a plurality of connectors.

2. Description of Related Art

The Universal Serial Bus (USB) standard is a well-known data transmission specification jointly established by IBM, Intel, Microsoft, NEC, Compaq, DEC, and Northern Telecom. Presently, USB is widely utilized to connect equipment with corresponding connectors, such as flash drives, portable hard drives, digital still and video cameras, mice, keyboards, scanners, printers, and so forth. The USB interface possesses a variety of advantages, such as fast data transmission speed, simple and quick connection, Plug-and-Play (PnP) compatibility, lack of an external power-supply, ability to simultaneously support a plurality of devices, excellent compatibility, and so forth, making USB a standard for connecting equipment to personal computers.

Referring to FIGS. 1A and 1B, FIG. 1A is a schematic diagram illustrating the exterior of a general USB male connector 100, whereas FIG. 1B is a sectional diagram illustrating the structure of the USB male connector 100 depicted in FIG. 1A. As shown in the drawings, a USB male connector 100 used in the prior art typically includes an insulating sealed casing 110 connected at its front end to a hollow metal socket 120 for connecting to a corresponding USB female connector (as shown in FIGS. 2A–2C). The top and bottom surfaces of the hollow metal socket 120 are formed with a plurality of fastening openings 130 for securing the USB male connector 100 when the metal socket connects to the corresponding USB female connector, the hollow part of the metal socket 120 being internally formed with a plurality of conductive terminals 140 for data transmission that are fastened onto a terminal fastening base 150.

Referring to FIGS. 2A to 2C, FIG. 2A is a schematic diagram illustrating the exterior of a general USB female connector 200, FIG. 2B is a sectional diagram of the structure of the USB female connector 200 depicted in FIG. 2A, and FIG. 2C illustrates the exterior of the rear end corresponding to the USB female connector 200 shown in FIG. 2A. As shown in the drawings, a USB female connector 200 as used in the prior art typically includes a casing having an inserting area 220, the top, bottom, right and left surfaces of the casing being formed with a plurality of fastening elastic slices 210, so as to tightly clip the metal socket 120 of the USB male connector 100 by fastening with the fastening openings 130 of the metal socket 120 as previously mentioned, thereby fastening the USB male connector 100 into the USB female connector 200. The inserting hole 220 is internally formed with a plurality of conductive terminals 230 so as to provide for data transmission with the rear end of each of the conductive terminals 230 extending rearward to form a soldering foot for soldering the USB female connector 200 onto a mounting area, such as a PC board.

FIG. 3 illustrates an application, wherein a first device 300, such as flash drive, is integrated with the USB male connector 100 shown in FIGS. 1A and 1B. FIG. 4 illustrates an application, wherein a second device 400, such as a flash reader, is integrated with the USB female connector 200 shown in FIGS. 2A to 2C. FIG. 5 illustrates a portable wireless receiver 500 as disclosed in TW Publication No. 572263, the portable wireless receiver 500 having the USB male connector 100 formed at one end and the USB female connector 200 formed at the other end of the portable wireless receiver 500, thereby enabling the portable wireless receiver 500 to both connect with a data processing device such as a computer system and other external equipment when required.

However, the foregoing portable wireless receiver 500 still has structural deficiencies. Firstly, the USB male connector 100 and the USB female connector 200 respectively installed on the front and back end of the portable wireless receiver 500 undesirably increase the length of the device, thus limiting its portability. Secondly, there is limited expandability of the portable wireless receiver 500 since the USB male connector 100 and the USB female connector 200 being installed thereon can, at most, connect to two external devices, thereby making the design unable to concurrently connect with a plurality of external devices. Thirdly, the design suggests that a protective cover or cap be put on the USB male connector 100 when not in use, but this undesirably increases the overall device length if applied, whereas omitting the protective cover could result in accidental damage occurring from an external force. Fourthly, the portable wireless receiver 500 cannot control the status of electrical connection of the USB male connector 100 and the USB female connector 200, thus the portable wireless receiver 500 cannot disconnect the device in situations where either one of the USB male connector 100 or the USB female connector 200 needs to be electrically disconnected. Fifthly, the portable wireless receiver 500 lacks a mechanism that can prevent wrong insertion, an example being in a situation where a user wishes to connect the USB male connector 100 to a data processing device but not the USB female connector 200 to any other device, wherein the portable wireless receiver 500 cannot enforce such connectivity limitations. Sixthly, the portable wireless receiver 500 cannot freely adjust the connection angle of the USB male connector 100 with respect to an external device, thereby making the design inflexible in terms of practical use.

Therefore, a need exists for an improved connector structure that has a plurality of connectors, a reduced overall length, a more compact size to conserve storage space, automated switch on/off functionality of the conductive connectors, ability to be adjusted to various angles as desired, and ability to prevent incorrect insertion or connectivity, whether intentional or unintentional.

SUMMARY OF THE INVENTION

In view of the foregoing drawbacks, a primary objective of this invention is to provide a novel connector structure that has a plurality of connectors for multiple uses.

Another objective of this invention is to provide a novel connector structure that can be freely adjusted to different angles as desired.

Another objective of this invention is to provide a novel connector structure that can selectively use one or more connectors at the same time.

Another objective of this invention is to provide a novel connector structure that can prevent incorrect insertion or connectivity from occurring.

Another objective of this invention is to provide a novel connector structure that can automatically switch on/off of the conductive connectors as desired.

Another objective of this invention is to provide a novel connector structure that has a relatively compact size for conserving storage space.

In accordance with the foregoing and other objectives, the present invention discloses a novel connector structure, comprising: a body having at least one containing space; at least one first connector being inwardly disposed on one end of the body; at least one second connector being pivotally disposed on the other end of the body that can be accommodated in the containing space of the body; and at least one rotating element being pivotally connected onto one end of the body, the foregoing second connector being fastened onto the rotating element, wherein the rotating element at least has one arm portion, one end of the arm portion being disposed with a pivotal connecting portion which connects to one end of the body, the arm portion being formed with a penetrating hole. The first connector can be a USB female connector or a USB male connector, and, likewise, the second connector can be a USB female connector or a USB male connector. The connector structure further optional comprises a switch actuated by the rotation of the pivotal connecting portion of the rotating element, the switch likely being a multi-linking-movement switch such that the rotating angles thereof are capable of controlling electrical conduction of the first connector and the second connector, wherein the pivotal connecting portion is driven by either gears or belt transmission to rotate and actuate the switch.

The design provides several advantages. Firstly, by opening a plurality of containing spaces in the body of the connector structure and disposing a plurality of rotating elements, the present invention can integrate a plurality of first or second connectors into the connector structure. Secondly, by disposing a second connector that is capable of free rotation, the body of the connector structure can be freely adjusted to all angles with respect to the second connector that connects to external equipment. Thirdly, by containing the second connector in the containing space or rotating to a certain angel with respect to the body, the first connector or the second connector can be optionally used. Fourthly, by containing the second connector in the containing space or by rotating it to a position outside of the body to block the first connector, the connector structure of the invention can respectively prevent incorrect insertion of the first and the second connectors. Fifthly, by disposing a controlling switch, electrical conduction of the first or the second connector can be automatically switched. Sixthly, by storing the second connector in the containing space when it is not in use, the device structure can have more connectors, yet provide for a smaller size in terms of its overall length as compared to prior art structures, making it easier to carry.

It should be noted that all of the ensuing drawings in this specification are simplified schematic diagrams to show only those parts related to the invention; and the parts illustrated are not drawn and depicted according to actual scale, size, or number, the details of which are arbitrary/willful design choices in the actual implementation of the invention.

BRIEF DESCRIPTION OF DRAWINGS

The invention can be more fully understood by reading the following detailed description of the preferred embodiments, with reference made to the accompanying drawings, wherein.

DETAILED DESCRIPTION OF PREFERRED EMBODIMENTS

Figure 1A:
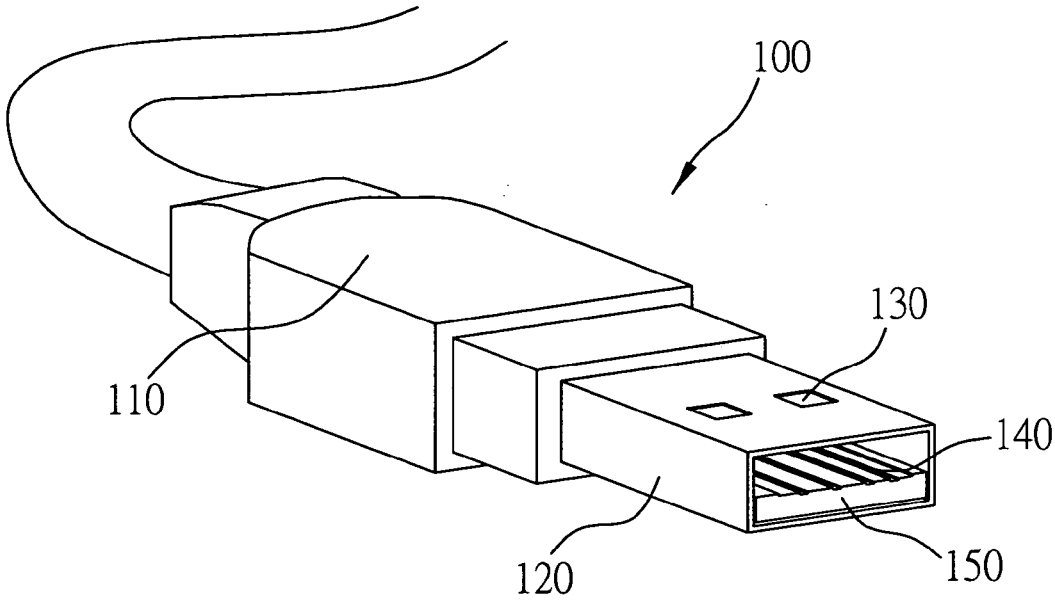
FIG. 1A (PRIOR ART)
FIGS. 1A and 1B (PRIOR ART) are schematic diagrams showing the structure of a USB male connector.
Figure 1B:
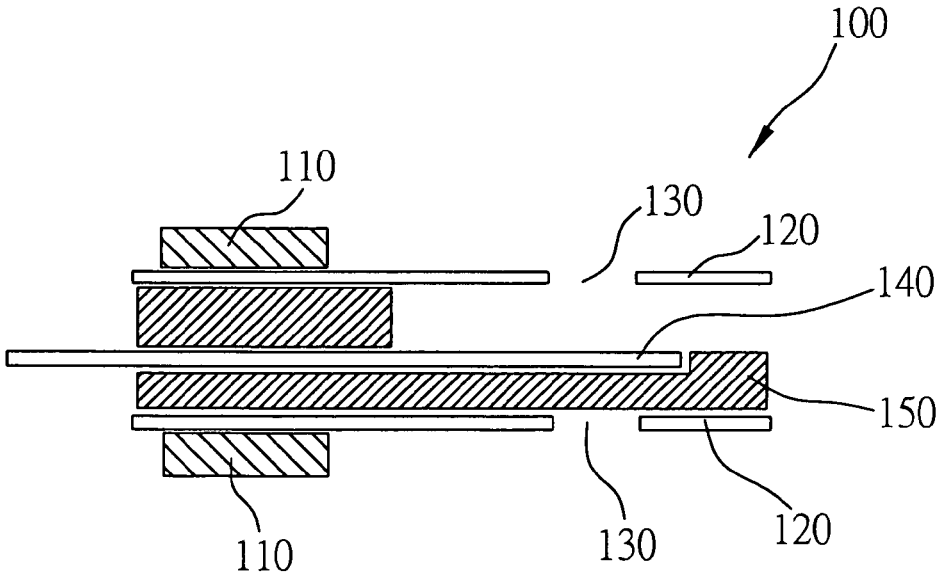
FIG. 1B (PRIOR ART)
Figure 2A:
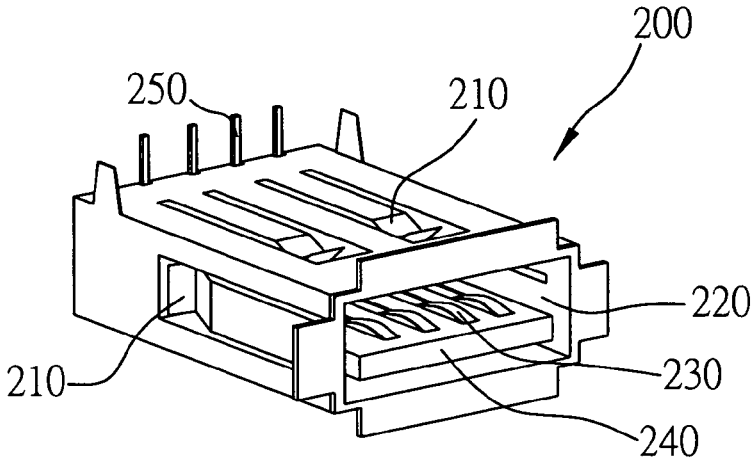
FIG. 2A (PRIOR ART)
FIGS. 2A–2C (PRIOR ART) are schematic diagrams showing the structure of a USB female connector.
Figure 2B:
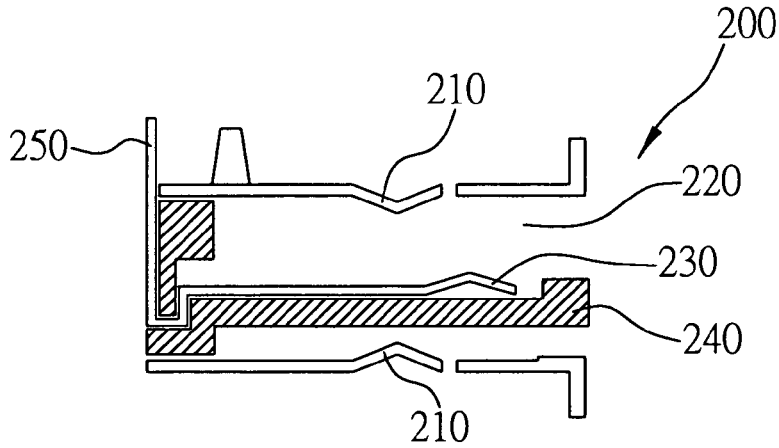
FIG. 2B (PRIOR ART)
Figure 2C:
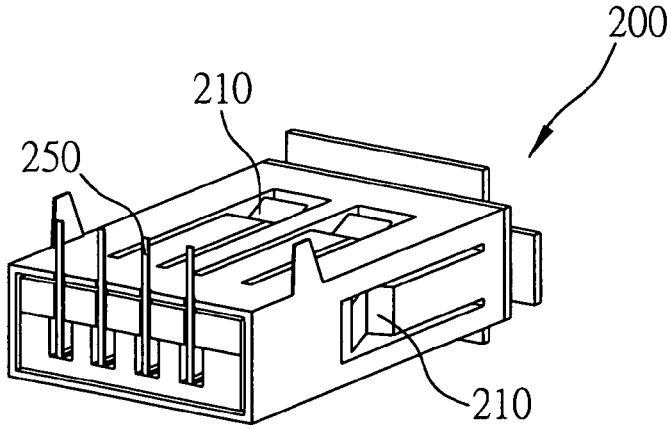
FIG. 2C (PRIOR ART)
Figure 3:
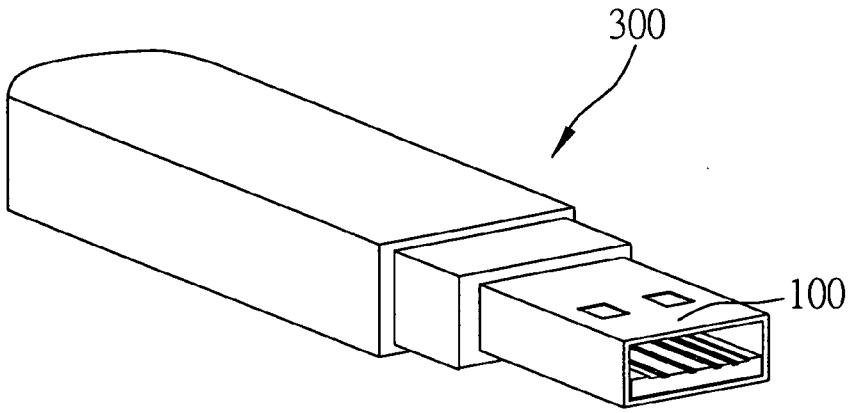
FIG. 3 (PRIOR ART)
FIG. 3 (PRIOR ART) is a schematic diagram showing the application of a first device employing the USB male connector of prior art.
Figure 4:
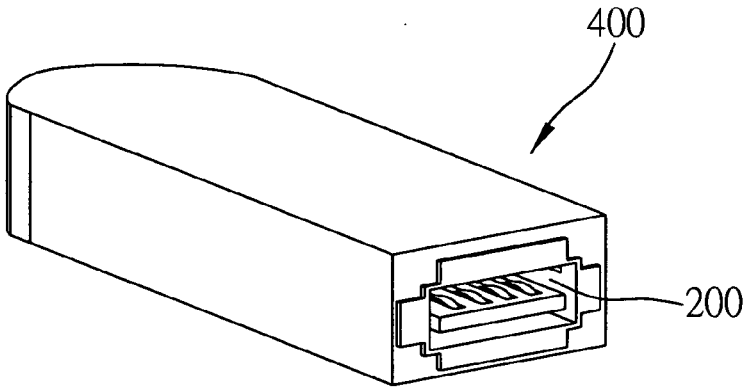
FIG. 4 (PRIOR ART)
FIG. 4 (PRIOR ART) is a schematic diagram showing the application of a second device employing the USB female connector of prior art.
Figure 5:
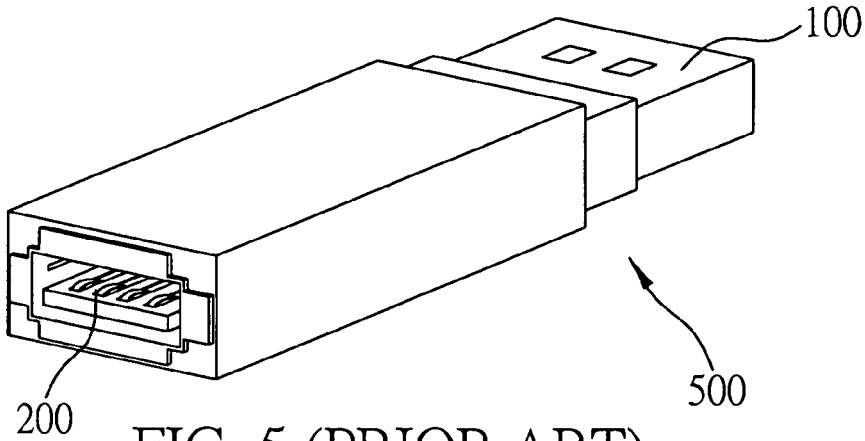
FIG. 5 (PRIOR ART)
FIG. 5 (PRIOR ART) is a schematic diagram showing the application of a third device as disclosed in TW Patent Publication No. 572263 concurrently using the USB male connector and the USB female connector of prior art.

These and other objects and advantages of the present invention will become more fully apparent from the following detailed description when read in conjunction with the accompanying drawings with like reference numerals indicating corresponding parts throughout for clarity and brevity, wherein:

The First Preferred Embodiment

Figure 6A:
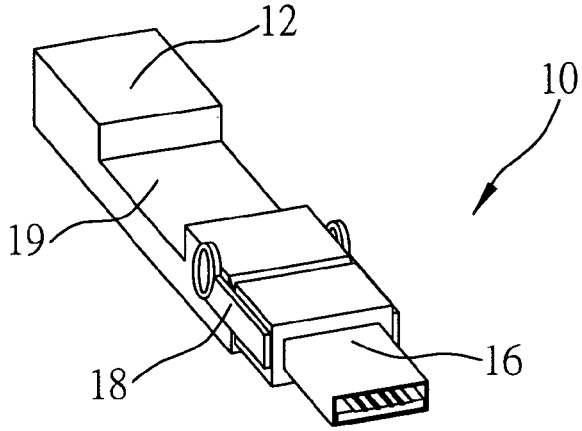
FIGS. 6A–6C are schematic diagrams showing a first preferred embodiment of the connector structure according to the present invention.
Figure 6B:
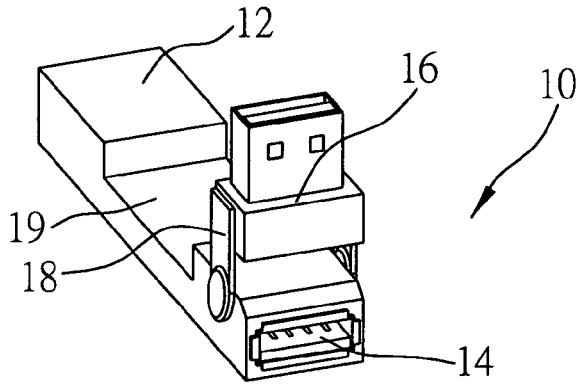
Figure 6C:
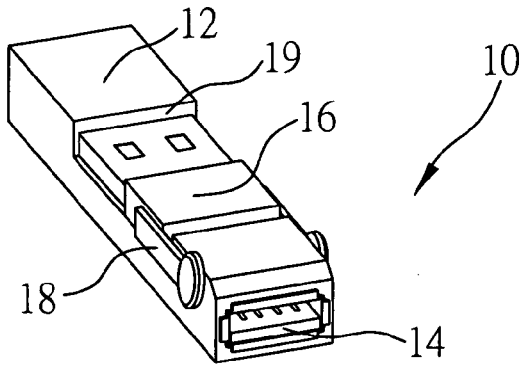

FIGS. 6A–6C illustrate a connector structure 10 of a first preferred embodiment of the invention comprising: a body 12; a first connector 14 disposed on an end of the body 12; and a pivotal second connector 16 pivotally disposed on the same end of the body 12. Also, the connector structure 10 of the invention can be disposed with a plurality of first connectors 14 or second connectors 16, the detailed description thereof being given in the following preferred embodiments. While this embodiment exemplifies only a first connector 14 and a second connector 16, the actual number of connectors used can vary and is not limited to that as disclosed in this embodiment.

The first connector 14 is inwardly installed on one end of the body 12 and can be a USB female connector. The USB female connector structure is a hardware interface known in prior art, and the description thereof will not be further detailed herein.

The second connector 16 is pivotally installed on an end of the body by means of a rotating element 18, the second connector 16 in this embodiment being installed on the same end of the body as the first connector 14, wherein the second connector 16 can be either a USB male connector or a USB female connector by design choice, with it being a USB male connector in this embodiment but not limited to this choice. The USB male connector structure is also a hardware interface known in prior art, and the description thereof will not be further detailed herein.

Figure 7:
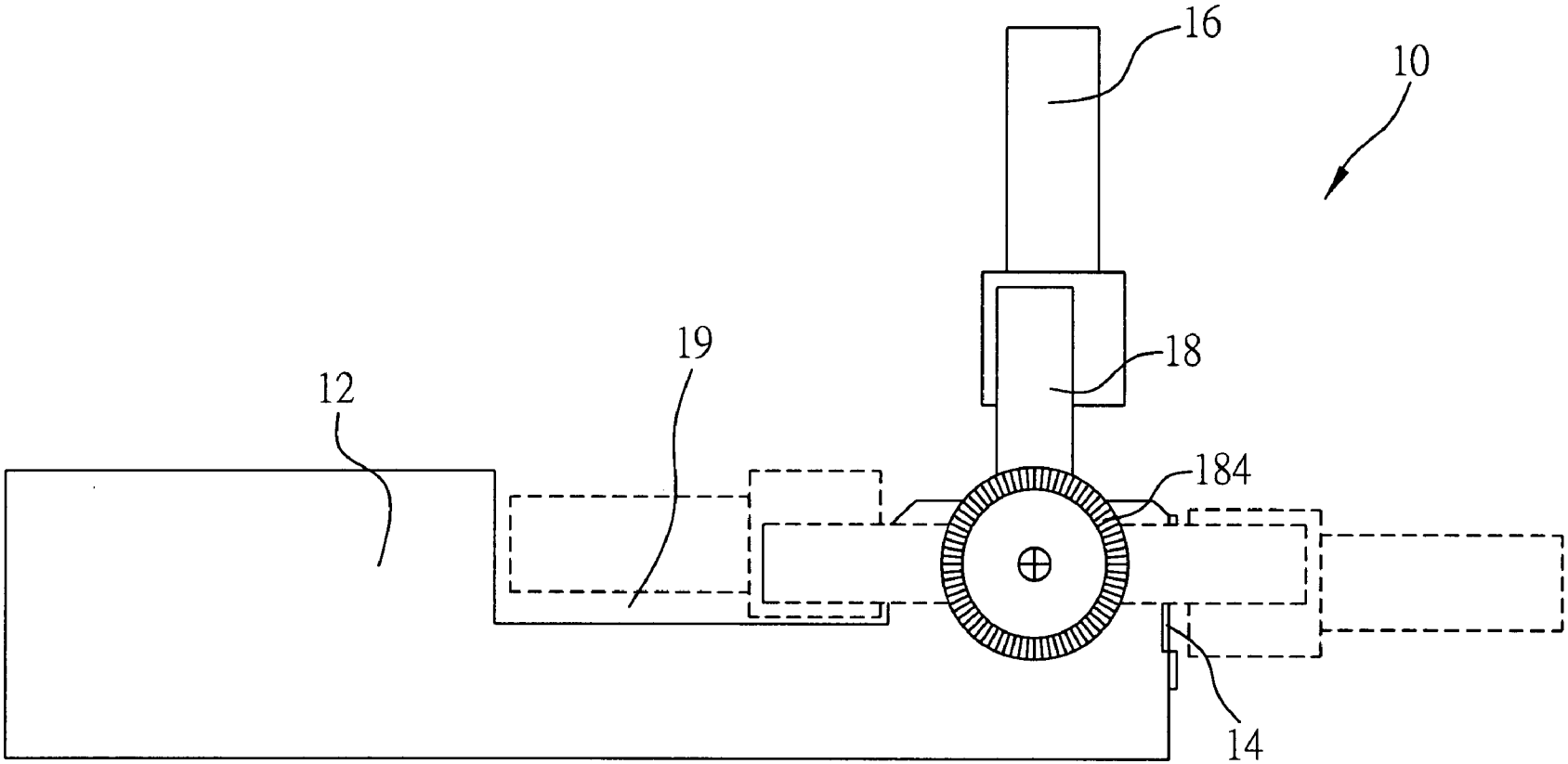
FIG. 7 is a schematic diagram showing the rotational movement of the connector structure as depicted in FIGS. 6A–6C.

A containing space 19 is formed in an appropriate position in the body 12, as illustrated in FIG. 6C. When the second connector 16 is not in use, it can be rotated into and accommodated by the containing space 19 of the body 12. A rotating schematic of the second connector 16 is illustrated in FIG. 7.

Figure 8:
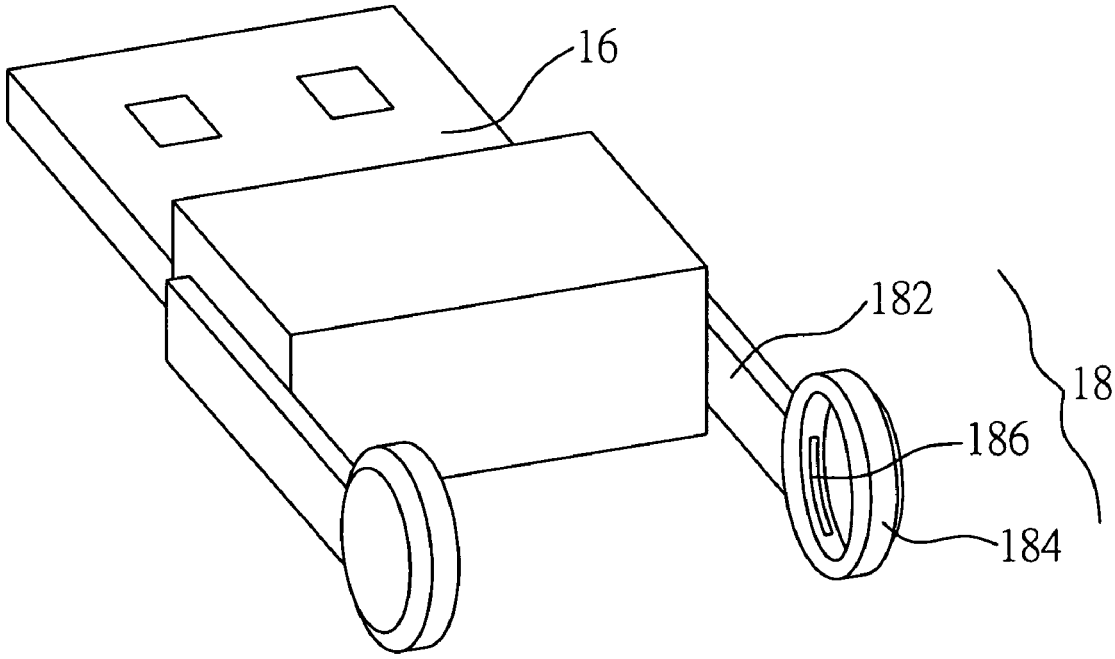
FIG. 8 is a schematic diagram showing a rotating element of the connector structure as depicted in FIGS. 6A–6C.

As illustrated in FIG. 8, the rotating element 18 comprises two arm portions 182, and one end of each arm portion is disposed with a pivotal connecting portion 184. Each of the two arm portions 182 of the pivoting element 18 is respectively pivotally disposed on the sides of one end of the body 12. The lower part of the second connector 16 is secured with the arm portions 182 away from one end of the pivotal connecting portion 184. Each of the arm portions 182 is internally disposed with a penetrating hole 186 for accommodating one or more conductive wires or a cable (not shown) therein, thereby allowing a conductive element (such as a circuit board) of the body 12 to electrically connect to the second connector 16 via the conductive wire of the penetrating hole 186.

Figure 9A:
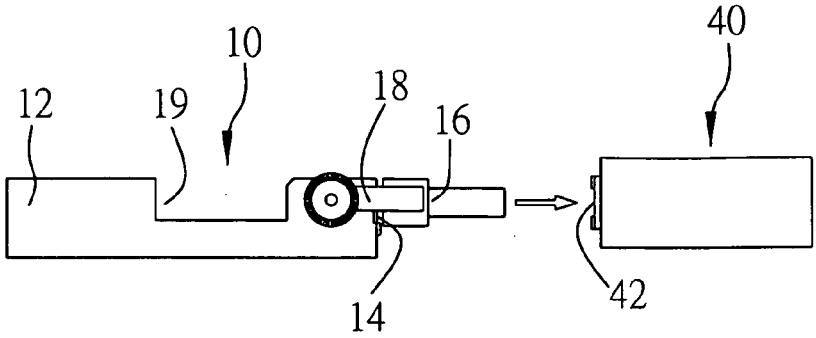
FIGS. 9A–9C are schematic diagrams showing the application of the connector structure as depicted in FIGS. 6A–6C.
Figure 9B:
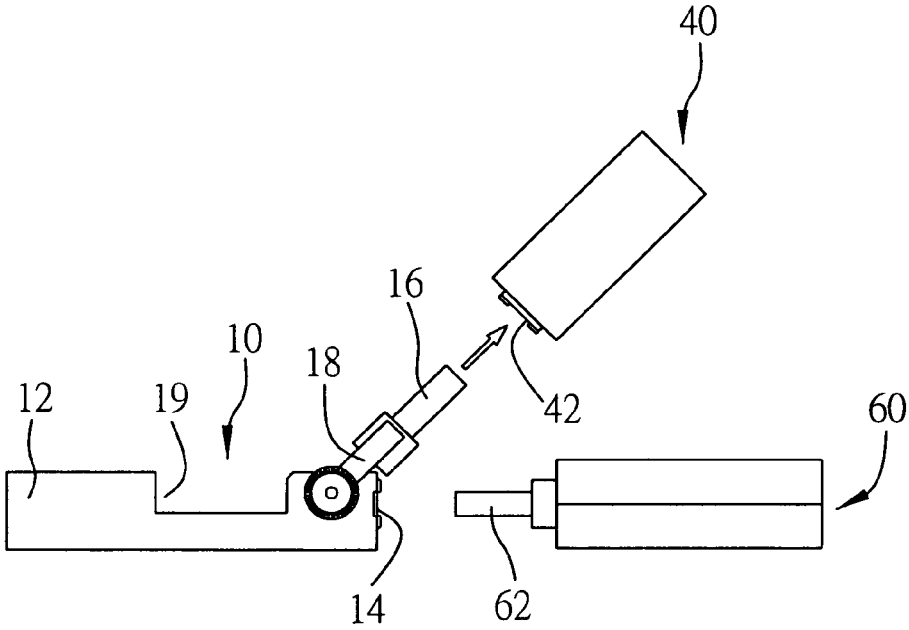
Figure 9C:
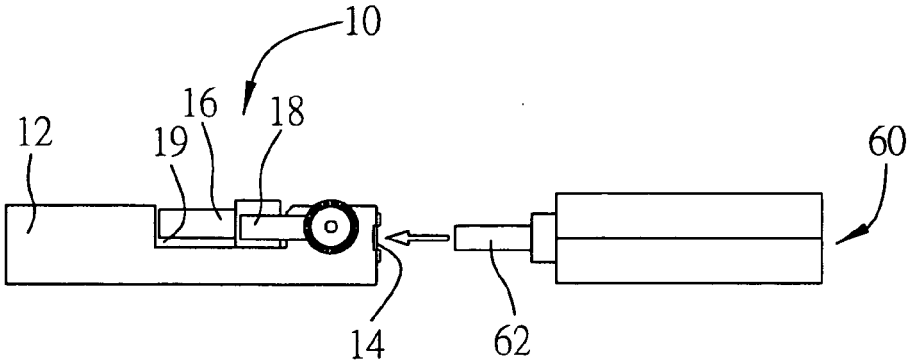

Referring to FIGS. 9A–9C, the connector structure 10 can connect with different external equipment. As shown in FIG. 9A, when the second connector 16 rotates to a position inline with the body 12, the first connector 14 is blocked by the second connector 16 and thus unable to connect with any external equipment or devices, thereby preventing the first connector 14 from being incorrectly or forcedly inserted with another device while the first connector 14 is connected to an external connector 42 of a first external device 40. As shown in FIG. 9B, the second connector 16 rotates to a certain angle with respect to the body 12 such that the first connector 14 is no longer blocked by the second connector 16 and thus able to connect to a second external connector 62 of a second external device 60 while the second connector 16 can connect to the first connector 42 at the same time. As shown in FIG. 9C, when the second connector 16 rotates into and is accommodated by the containing space 19 of the body 12, the second connector 16 is blocked by the walls of the containing space 19 and thus unable to be connected with other external devices, thereby preventing the second connector 16 from being incorrectly or forcedly inserted with another device while the first connector 14 is or can be connected to an external device 60.

From the above descriptions of the connector structure 10, it can be understood that the first connector 14 and the second connector 16 can be optionally used, and the design has advantages in curtailing incorrect usage. Also, the connector structure 10 can freely adjust the connection angle of the second connector 16 thereof with respect to the longitudinal axis of the body to more flexibly connect with external equipment or data processing devices. And, when the second connector 16 is accommodated into the containing space 19 of the body 12, the overall length of the connector structure 10 is reduced and thus is easier to carry.

The Second Preferred Embodiment

Figure 10:
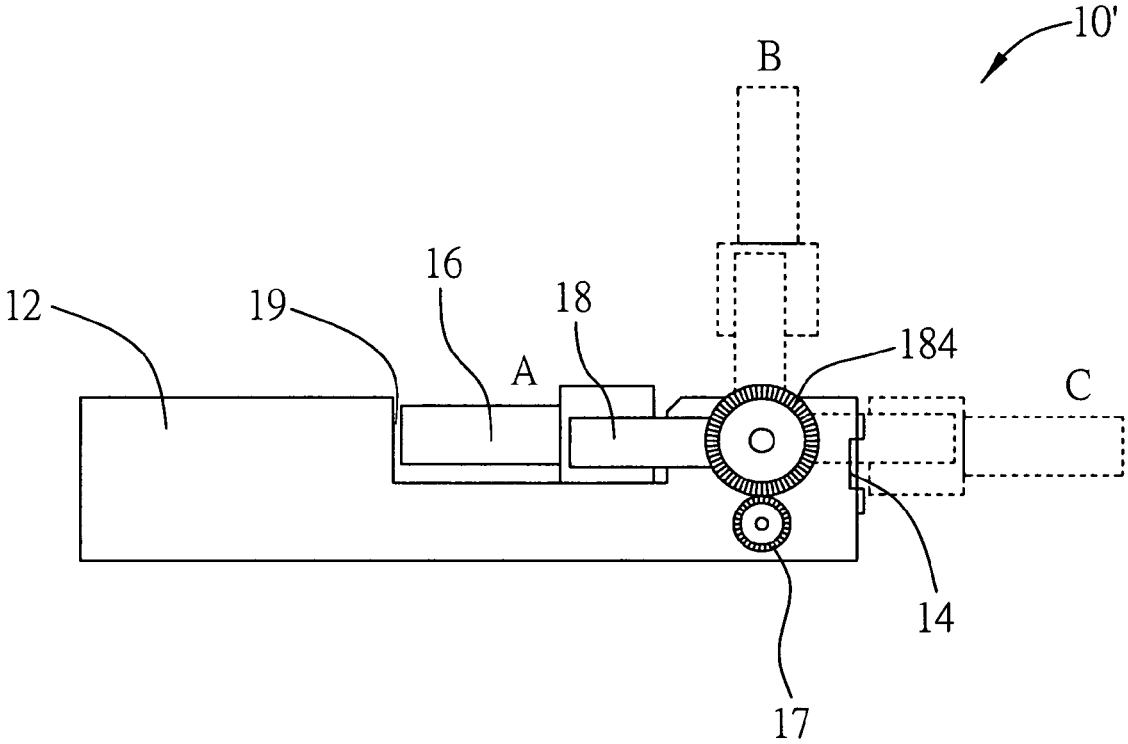
FIG. 10 is a schematic diagram showing a second preferred embodiment of the connector structure according to the present invention.

As shown in FIG. 10, basically the connector structure 10' in this preferred embodiment is structurally similar to the connector structure 10 of the first preferred embodiment, and only differs in that a switch 17 is additionally disposed on the body 12. When the pivotal connecting portion 184 of the rotating element 18 thereof rotates to a first location A, a second location B, and a third location C as shown with respect to the second connector 16, the switch 17 is actuated by means of the conventional gear transmission or belt transmission as known in the prior art, wherein the first location A is a location where the second connector 16 is accommodated into the containing space 19, the second location B can be a location where the second connector 16 is perpendicular with respect to the body 12, and the third location C is a location where the second connector 16 rotates to an inline position, with respect to the body, outside of the body 12.

Figure 11:
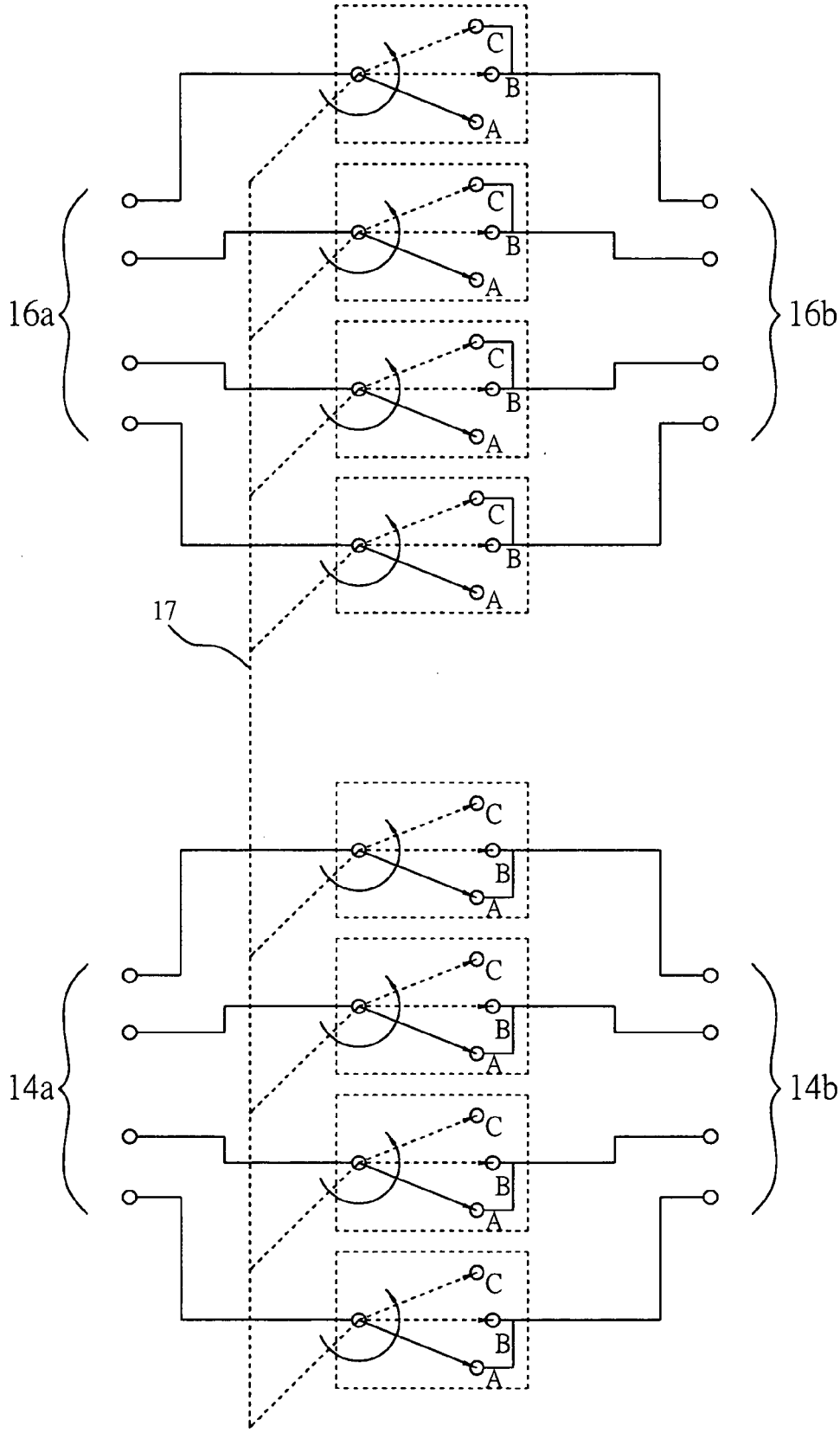
FIG. 11 is a theory diagram showing the rotation of the connector structure as depicted in FIG. 10.

Referring to FIG. 10 in conjunction with FIG. 11, the switch 17 can be a multi-linking-motion switch, the reference numerals 16*a* and 16*b* as indicated in the drawing being respectively input terminals and output terminals of the second connector 16, wherein the electrical connection of the input terminals 16*a* and the output terminals 16*b* is decided by the rotation angle of the switch 17. Likewise, reference numerals 14*a* and 14*b* each respectively are input terminals and output terminals of the first connector 14, wherein the electrical connection of the input terminals 14*a* and the output terminals 14*b* is also decided by the rotation angle of the switch 17. When the second connector 16 rotates to a first location A as shown in FIG. 10, the switch 17 is actuated to rotate to a corresponding first location as indicated in FIG. 11, wherein, at this time, the input terminals 16*a* and the output terminals 16*b* of the second connector 16 are not electrically connected, whereas the input terminals 14*a* and the output terminals 14*b* of the first connector 14 are electrically connected, thereby putting the second connector 16 in a non-working status while the first connector 14 is in a working status, providing that it is connected to other external equipment. When the second connector 16 rotates to a second location B as shown in FIG. 10, the switch 17 is actuated to rotate to a corresponding second location as indicated in FIG. 11, wherein, at this time, the input terminals 16*a* and the output terminals 16*b* of the second connector 16 are electrically connected, and the input terminals 14*a* and the output terminals 14*b* of the first connector 14 are also electrically connected, thereby making the second connector 16 and the first connector 14 both in a working status. When the second connector 16 rotates to a third location C as shown in FIG. 10, the switch 17 is actuated to rotate to a corresponding third location as indicated in FIG. 11, wherein, at this time, the input terminals 16*a* and the output terminals 16*b* of the second connector 16 are electrically connected, whereas the input terminals 14*a* and the output terminals 14*b* of the first connector 14 are not electrically connected, thereby putting the first connector 14 in a non-working status while the second connector 16 is in a working status, providing it is connected to other external equipment or a data processing device.

By the additional provision of the switch 17, electrical connection of the first connector 14 and the second connector 16 can be controlled, such that the working status of the first connector 14 and the second connector 16 can be reliably and automatically switched as desired.

The Third Preferred Embodiment

Figure 12:
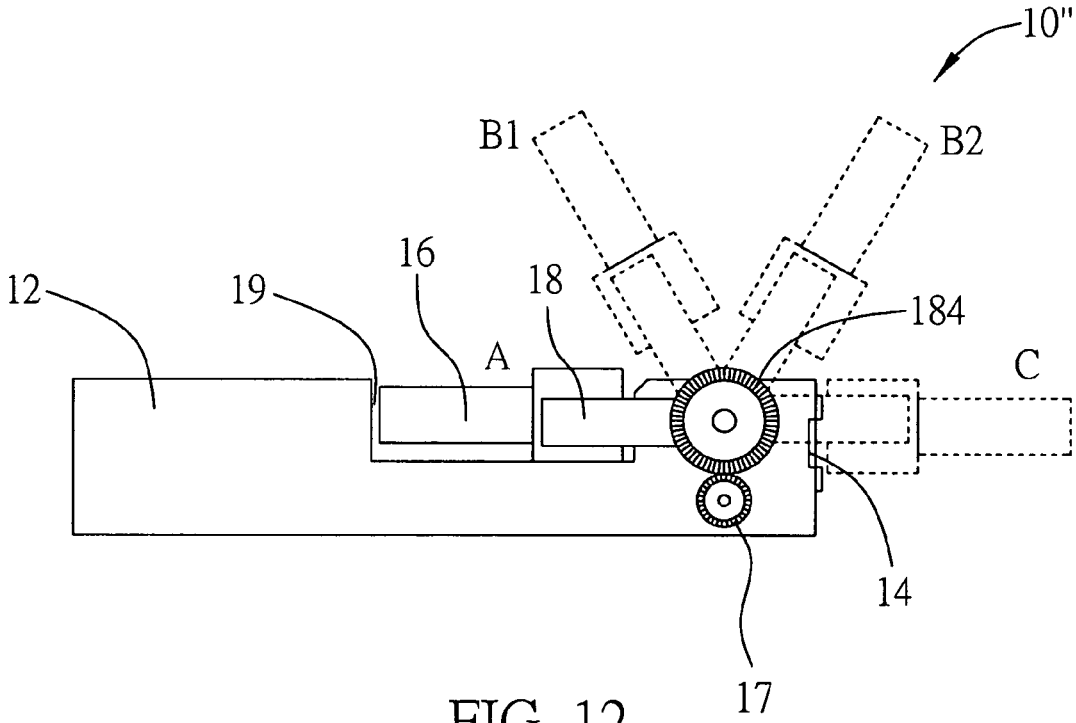
FIG. 12 is a schematic diagram showing a third preferred embodiment of the connector structure according to the present invention.
Figure 13:
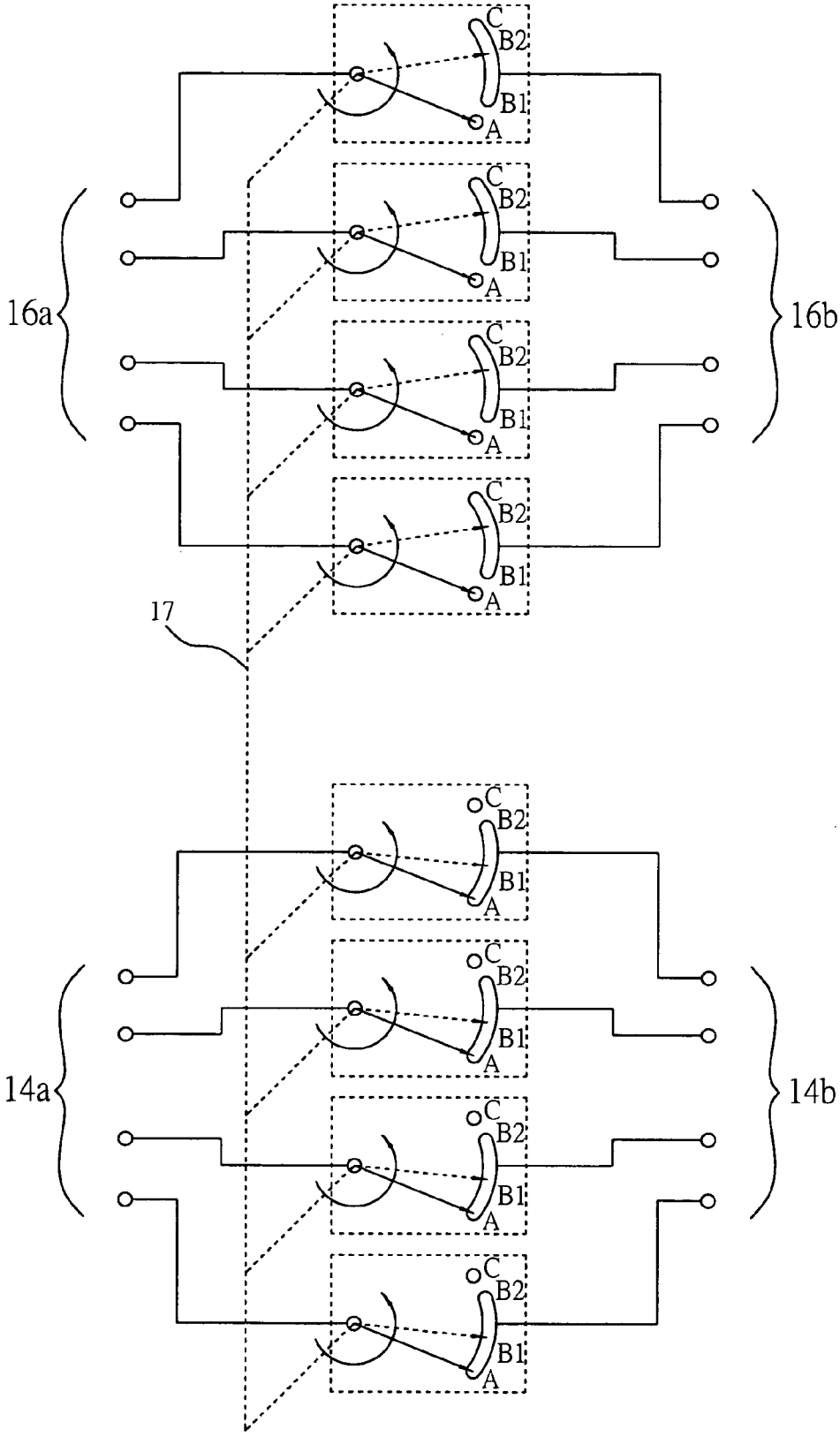
FIG. 13 is a theory diagram showing the rotation of the connector structure as depicted in FIG. 12.

As shown in FIGS. 12 and 13, basically this preferred embodiment is structurally similar to the connector structure 10' of the second preferred embodiment, and is an improvement on the second preferred embodiment.

In the second preferred embodiment, the connector structure 10' enables the first connector 14 and the second connector 16 to be electrically connected when the second connector 16 thereof rotates to a specific B location, however, this undesirably and significantly limits the connecting angles of the second connector 16 with the external equipment or data processing device.

In this third preferred embodiment, the second connector 16 of the connector structure 10" is in any arbitrary position between the first location B1 and the second location B2, as shown in FIG. 12, making the first connector 14 and the second connector 16 both electrically connected. As shown in FIG. 13, this embodiment enables electrical connection between the first location A to the second location B2 at a position that corresponds to the output terminals 14*b* of the first connector 14, and the electrical connection between the first location B1 to the third location C at a position that corresponds to the output terminals 16*b* of the second connector 16.

When the switch 17 is actuated at a position between the first location A and the first location B2, the first connector 14 is electrically connected but not the second connector 16; and when at a position between the first second location B1 and the second location B2, the first connector 14 and the second connector 16 are both electrically connected; and when at a position between the second location B2 and the third location C, the first connector 14 is not electrically connected but the second connector 16 is electrically connected.

It can be seen from the connector structure 10" in this preferred embodiment, when the second connector thereof rotates within a range of angles, the first connector 14 and the second connector 16 are both electrically connected at the same time, thereby allowing the switch 17 to freely switch the working status of the first connector 14 and the second connector 16.

The Fourth Preferred Embodiment

Figure 14:
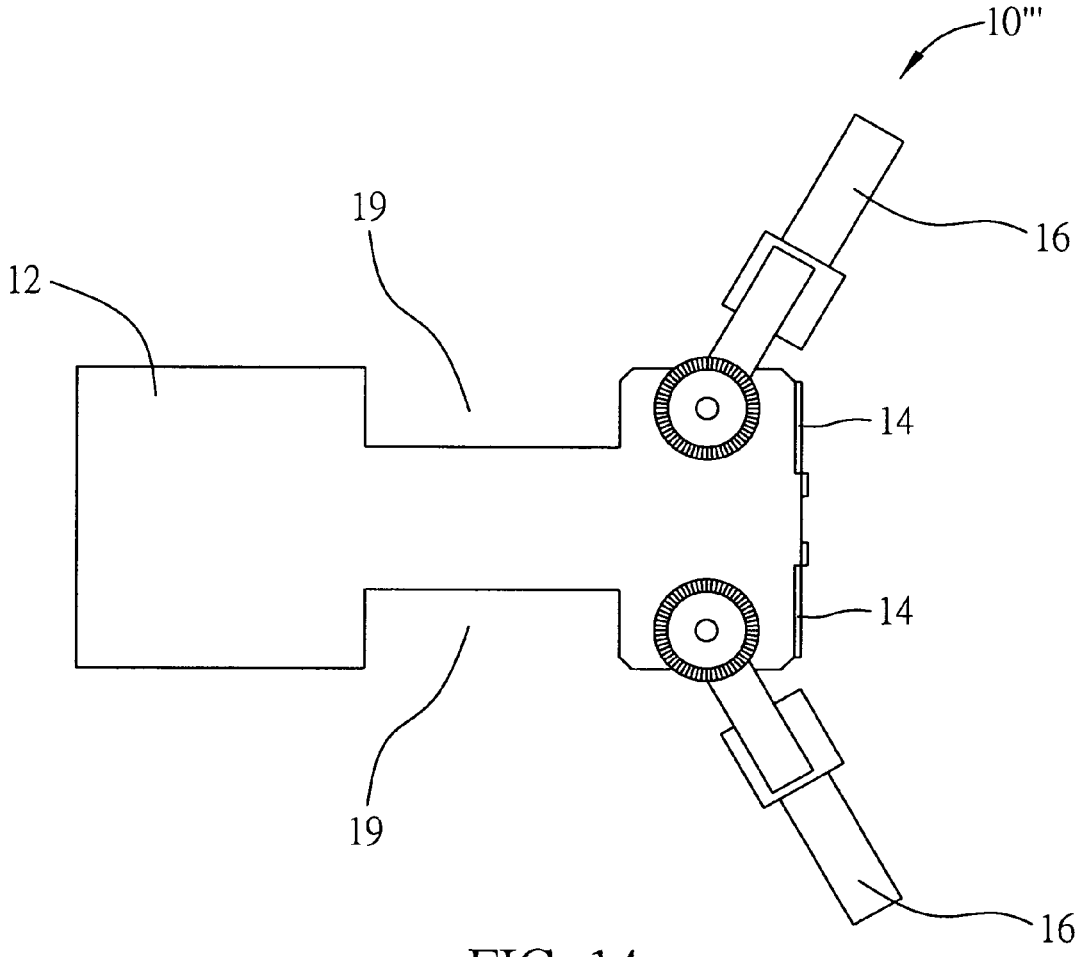
FIG. 14 is a schematic diagram showing a fourth preferred embodiment of the connector structure according to the present invention.

As shown in FIG. 14, basically this preferred embodiment is structurally similar to the connector structure 10 of the first preferred embodiment, and only differs in that each of the top and bottom surfaces of the body 12 of the connector structure 10'" is respectively disposed with a containing space 19, and on a top and a bottom end of the body 12 are each respectively disposed with a pivotal second connector 16, such that the second connector 16 can be respectively accommodated into the containing spaces 19. Similarly, the top and bottom ends of the body 12 each can be either pivotally disposed with a first connector 14, or a first connector 14 and a second connector 16 depending on the actual implementations. Further, the surface end of the body 12 can be concurrently disposed with two or even more than two first connectors 14 as desired. Therefore, the connector structure 10'" used in the preferred embodiment can have a plurality of connectors as desired to meet the requirements of concurrently connecting to a plurality of external equipment or data processing devices. The invention is therefore more advantageous to use than the prior art.

It should be noted that the foregoing embodiments are only exemplified to describe the concepts and functions but are not intended to limit the invention in any way. For example, the rotating element 18 of the connector structure 10 according to the invention can be respectively disposed on the ends of both sides of the body 12, or disposed on one side only; also, in addition to the aforementioned gear or belt transmission, the pivotal connecting portion 184 of the rotating element 18 thereof can adopt other means of transmission to actuate the switch 17 depending on the mode of implementation.

The invention has been described using exemplary preferred embodiments. However, it is to be understood that the scope of the invention is not limited to the disclosed embodiments. On the contrary, it is intended to cover various modifications and similar arrangements. The scope of the claims, therefore, should be accorded the broadest interpretation so as to encompass all such modifications and similar arrangements.

What is claimed is:

1. A connector structure, comprising:

a body having at least one containing space;

at least one first connector being inwardly disposed at one end of the body;

at least one second connector being pivotally disposed on the other end of the body, and that can be accommodated in the containing space of the body; and at least one rotating element being pivotally connected onto one end of the body and coupled with the second connector, wherein when the second connector rotates to a position inline with the body, the first connector is blocked by the second connector.

2. The connector structure of claim 1, wherein the rotating element at least has one arm portion, one end of the arm portion being disposed with a pivotal connecting portion which connects to one end of the body.

3. The connector structure of claim 1, wherein the first connector is a USB female connector.

4. The connector structure of claim 1, wherein the first connector is a USB male connector.

5. The connector structure of claim 1, wherein the second connector is a USB female connector.

6. The connector structure of claim 1, wherein the second connector is a USB male connector.

7. The connector structure of claim 1, further comprising a switch actuated by the rotation of a pivotal connecting portion of the rotating element of the connector structure.

8. The connector structure of claim 2, wherein the arm portion is formed with a penetrating hole in which a conductive wire is formed therein for electrically connecting a conductive element installed in the body to the second connector.

9. The connector structure of claim 7, wherein the switch is an optional multi-linking-movement switch and the rotation angle thereof is capable of controlling electric conduction of the first connector and the second connector.

10. The connector structure of claim 7, wherein the pivotal connecting portion can be driven by either gears or belt transmission to rotate and actuate the switch.

* * * * *